US005890874A

United States Patent [19]

Lambert et al.

[11] Patent Number: 5,890,874

[45] Date of Patent: Apr. 6, 1999

[54] ROTORS FOR GAS TURBINE ENGINES

[75] Inventors: David M Lambert, Derby; David S Knott, Leicester; Peter R Beckford, Derby, all of England

[73] Assignee: Rolls-Royce plc, London, England

[21] Appl. No.: 780,619

[22] Filed: Jan. 7, 1997

[30] Foreign Application Priority Data

Feb. 2, 1996 [GB] United Kingdom ..... 9602129

[51] Int. Cl.[6] ..... F04D 29/38

[52] U.S. Cl. ..... 416/193 A

[58] Field of Search ..... 416/193 A, 190, 416/191

[56] References Cited

U.S. PATENT DOCUMENTS 4,183,720 1/1980 Brantley .

4,580,946 4/1986 Bobo ..... 416/190

FOREIGN PATENT DOCUMENTS 2 171 151 8/1986 United Kingdom .

93/22539 11/1993 WIPO .

*Primary Examiner*—John T Kwon

*Attorney, Agent, or Firm*—W. Warren Taltavull

[57] ABSTRACT

A rotor for a ducted fan gas turbine engine includes a rotor disc on which a number of circumferentially spaced apart blades are mounted. Wall members are positioned to bridge the space between adjacent blades. The wall members correspond in profile with the blades adjacent thereto. A seal is mounted on a side face of each wall member and is bonded to a flexible mounting which is bonded itself to the wall member. The flexible mounting has elastic properties so as to allow the seal to deflect relative to the wall member under centrifugal loading during operation.

8 Claims, 4 Drawing Sheets

ROTORS FOR GAS TURBINE ENGINES

FIELD OF THE INVENTION

This invention relates to rotors for ducted fan gas turbine engines. More particularly but not exclusively the invention relates to seals for fan blades of a fan rotor for compressing air.

BACKGROUND OF THE INVENTION

Conventionally a fan rotor for compressing air comprises a disc having a plurality of radially extending blades mounted thereon. The fan blades are mounted on the disc by inserting the inner end of the blade in a correspondingly shaped retention groove in the outer face of the disc periphery. Separate wall members bridge the space between pairs of adjacent blades to define the inner wall of an annular gas passage in which the fan rotor is operationally located.

It is known to provide a seal between the wall members and the adjacent fan blades by providing resilient strips bonded to the wall member edges adjacent the fan blades. The strips protrude so that they abut and seal the adjacent fan blades. This prevents air leaking past the inner wall of the annulus.

However the above described arrangement has the main drawback that the resilient strips are necessarily in a close fit with the adjacent blades, leading to assembly difficulties WO 93/22539 discloses an improvement to the above arrangement where the inner wall of the flow annulus is defined by a plurality of wall members which are provided with resilient strips allowing for easier assembly.

The wall members bridge the space between adjacent fan blades and each comprise a platform having a foot which engages within a similarly shaped groove of the disc. Flanges are bonded to the platform, each flange having a resilient seal. As the fan rotates the flanges are directed outwards into sealing contact with the adjacent fan blades to seal the inner wall of the flow annulus.

This arrangement, however, has certain disadvantages. Aerodynamic losses occur due to the necessary gap between the blade surface and seal. The gap in the prior art arrangement is required to be relatively large to accommodate blade dynamic movement during for example bird impact and when a blade may become detached. The flange sealing element normally operates (provides a seal) at around 6000*G. However, as the rotor speed increases, the end of the flange is subject to increased load and the seal becomes more prone to 'flip out' leading to efficiency losses and vibration problems. In addition the rubber seals tend to split and degrade during use and need to be replaced at regular intervals. Another problem is that the seals pick up titanium oxides from the blade surface causing damage to the blade surface through scratching. The seals are also costly to produce and are undesirably heavy.

SUMMARY OF THE INVENTION

It is an aim of the present invention, therefore, to provide a rotor for a gas turbine assembly which alleviates the aforementioned problems.

According to the present invention there is provided a rotor for a gas turbine engine comprising a rotor disc which has a periphery on which a plurality of circumferentially spaced apart radially extending blades are mounted, discrete wall members are provided to bridge the space between adjacent blades and define an inner wall of a flow annulus through the rotor, each of the wall members being attached to the periphery of the disc and having opposing side faces which are spaced circumferentially from the adjacent blades and which correspond in profile with the blades adjacent thereto, a seal being mounted adjacent at least one opposing side face of a wall member, wherein said seal is bonded to a flexible mounting (30), said flexible mounting (30) being bonded to one of said wall member face and blade, the flexible mounting (30) having elastic properties so as to allow the seal to deflect relative to said wall member under centrifugal loading and sealingly engage the blade adjacent thereto.

The above arrangement provides the aerodynamic advantages of a full fillet seal between the fan blade surfaces and the inner annulus surface. The present invention accommodates such movement by utilising movement of the flexible mounting in cooperation with the stiffness of the seal. The flexible mounting provides a see-saw effect which absorbs movement of the seal thus providing an effective sealing arrangement.

The undesirable gap between the fan blade and seal which was present in the prior art sealing arrangement and the problems associated with air re-circulation are alleviated. The gap was previously required to accommodate blade movement during impact from foreign objects.

Also according to the present invention there is provided a seal for a ducted fan gas turbine blade wherein said seal comprises at least two segmented portions, said segmented portions being arranged to overlap an adjacent portion of said seal.

Segmenting the seal alleviates some of the inherent 3D stiffness of seal whilst still allowing the seal to move through movement of the flexible bonding material attached thereto.

In one embodiment of the invention the flexible mounting comprises the adhesive for bonding the seal to one of said blade and platform.

Preferably the seal is manufactured from a carbon reinforced composite material so as to provide a seal with the required stiffness.

In one embodiment the seals are curved in both the longitudinal and radial directions. This design has been found to provide a close sealing fit with the blade.

In another embodiment of the invention the seal is provided with a centre of gravity which is at a position opposite to the blade of a radial line passing through the centre of movement of the seal. This arrangement enables the seal to perform in a see-saw manner utilising the inherent elasticity of the bonding material and accommodating the undulations of the fan blade during use.

BRIEF DESCRIPTION OF THE DRAWINGS

The present invention will now be described with reference to the accompanying drawings in which.

DETAILED DESCRIPTION OF THE INVENTION

Figure 1:
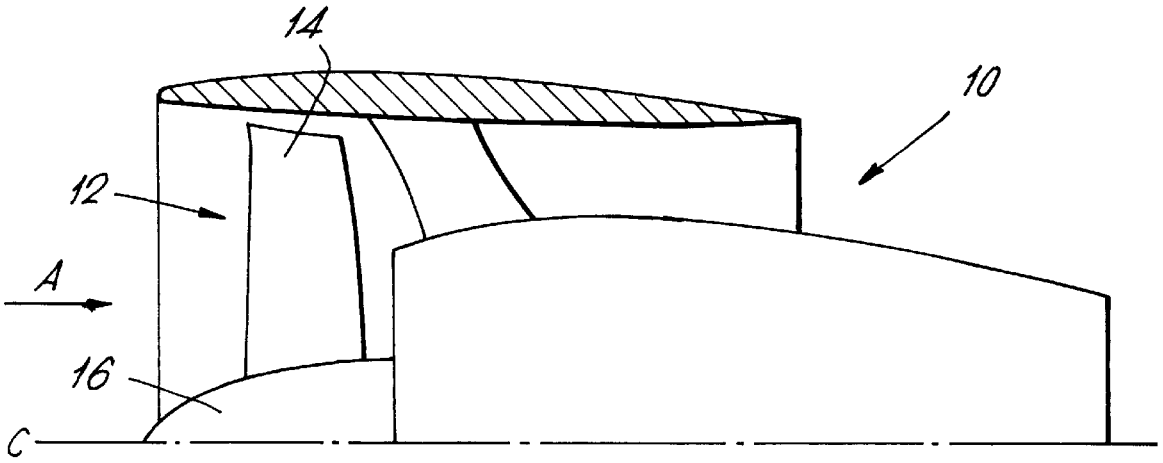
FIG. 1 is a diagrammatic view of the well known gas turbine engine incorporating a rotor in accordance with the present invention.
Figure 2:
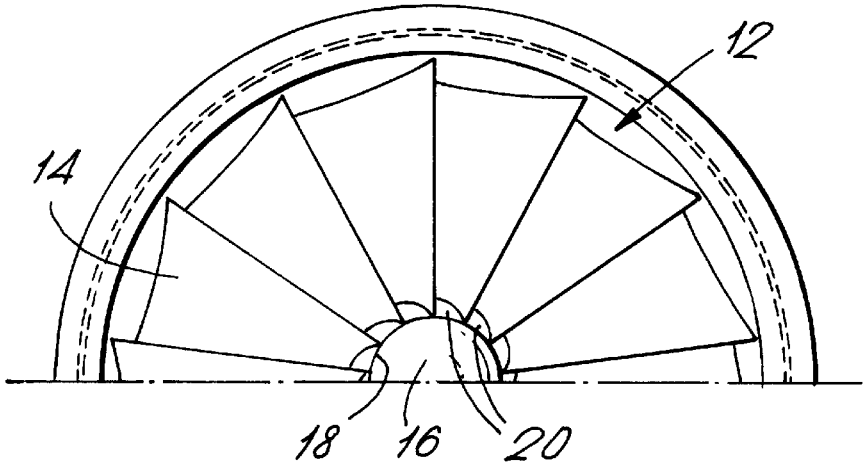
FIG. 2 is a view of the rotor in the direction of arrow A in FIG. 1

With reference to FIG. 1 a known gas turbine engine 1 operates in a conventional manner has a fan rotor 12 arranged at its upstream end.

The fan rotor 12 consists of a number of fan blades 14 which are mounted on radially outer face 18 of a disc 16. The fan blades 14 do not have platforms and the space between adjacent pairs of blades is bridged by wall members 20.

The wall members 20 are fastened to the disc periphery 18 of and define the inner wall of a flow annulus for air compressed by the fan.

Each wall member 20 consists of a platform 22 having a foot 24 of dovetail cross section, which extends radially inwardly of the platform 22. The foot 24 engages a correspondingly shaped retention groove 25 on the radially outer face 18 of disc 16. Axial movement of the wall members 20 is prevented by mounting an annular ring known as a thrust ring in the disc 16.

Figure 3:
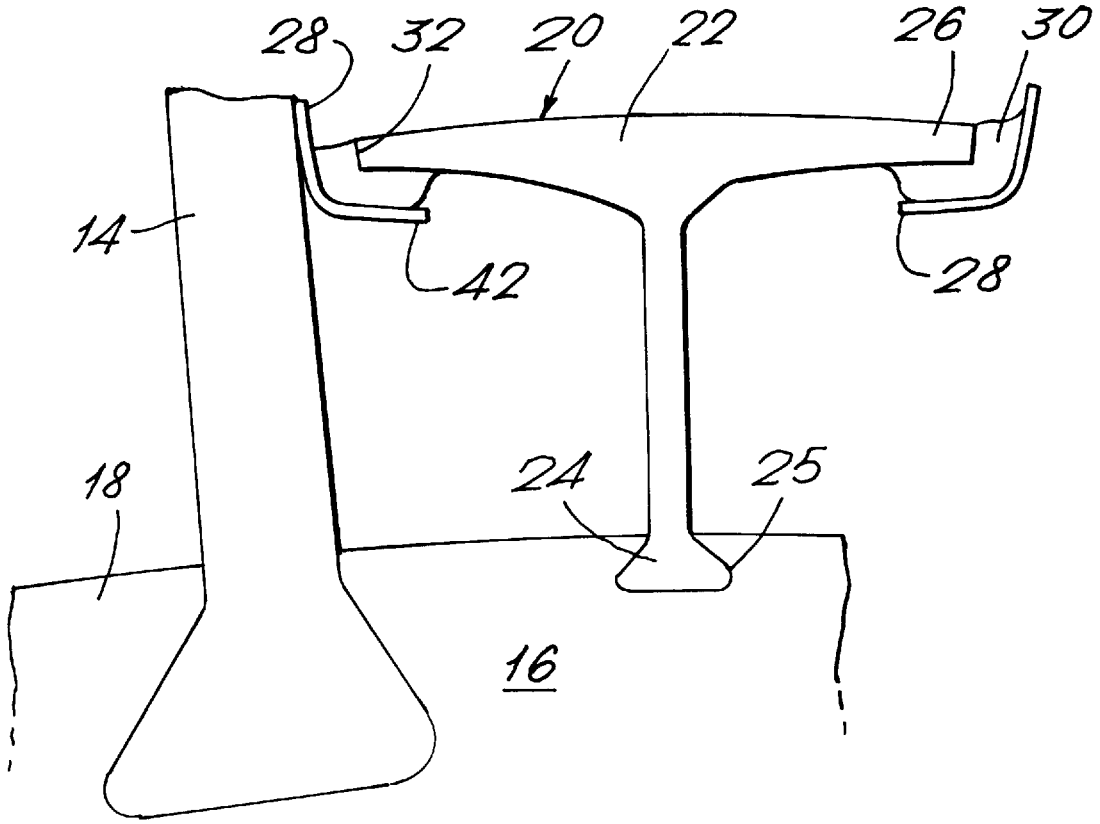
FIG. 3 is an enlarged view of part of the rotor shown in FIG. 2 incorporating one embodiment of the seal and flexible mounting.
Figure 4:
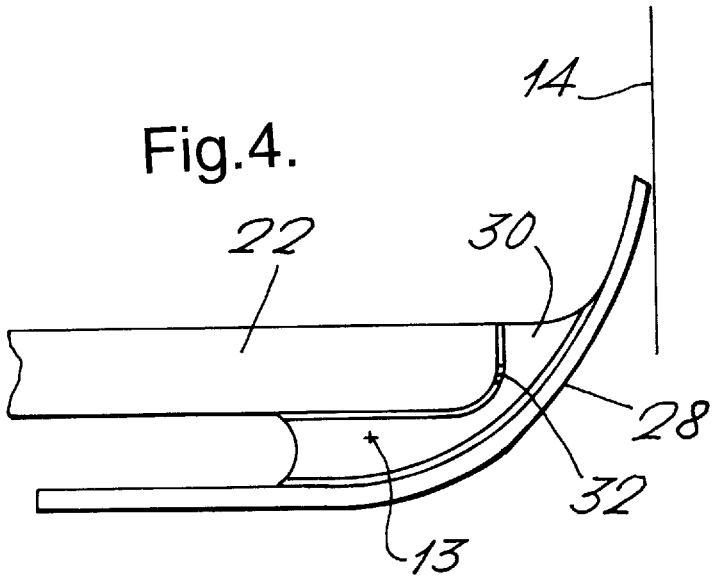
FIG. 4 is a view of the seal and flexible mounting of FIG. 3 for use in a rotor in accordance with the invention.

In FIGS. 3 and 4 the platform 22 has axially extending side edges 26 which are in close proximity to the adjacent fan blade 14. Each side edge 26 of the platform 22 is provided with a seal strip 28 bonded to the flexible mounting 30. The flexible mounting is then bonded to the platform 22.

In the embodiment illustrated in FIG. 3 and FIG. 4 the flexible mounting 30 extends along the base of the platform 22 and upwards along the end edge 32. The seal 28 cooperates with the fan blade 14. The centre of gravity of the seal is at position B underneath the platform 22. This arrangement allows the seal to remain in sealing contact with the blade during operation of the rotor. Blade dynamic movements are accommodated by the flexible 'see-saw' movement of the flexible mounting 30.

Figure 5:
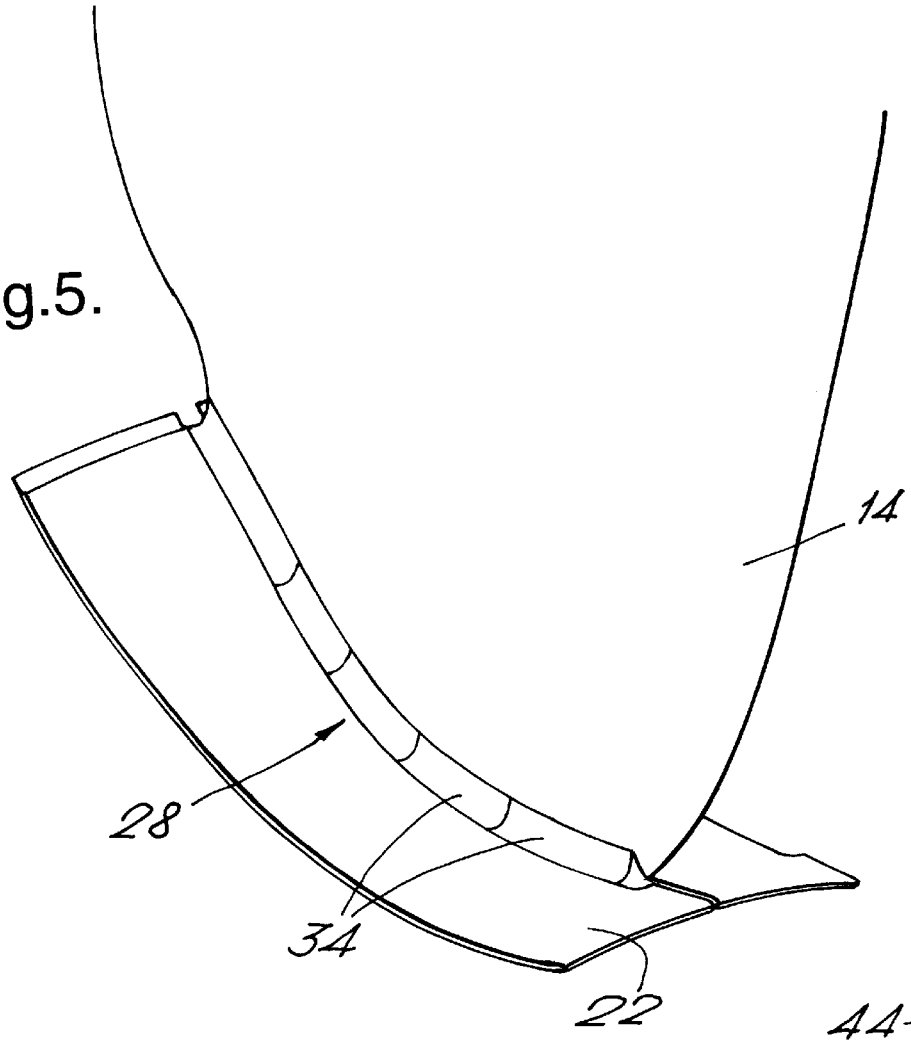
FIG. 5 is a view of a segmented seal of the present invention shown assembled in contact with the fan blade.

In FIG. 5 the seal 28 including overlapping segments 34, is shown in its longitudinal direction in sealing cooperation with the blade 14 and attached to platform 22. The segments 34 are preferably of identical or similar stiffness. The method of providing segments 34 within the seal 28 comprises the use of a release film 36 inserted within the segmented portion of the seal for providing a sliding arrangement between the segments. This helps to prevent the segments sticking during manufacture and also helps to ensure that the sliding portions of the segments 34 do not part during use.

Figure 6:
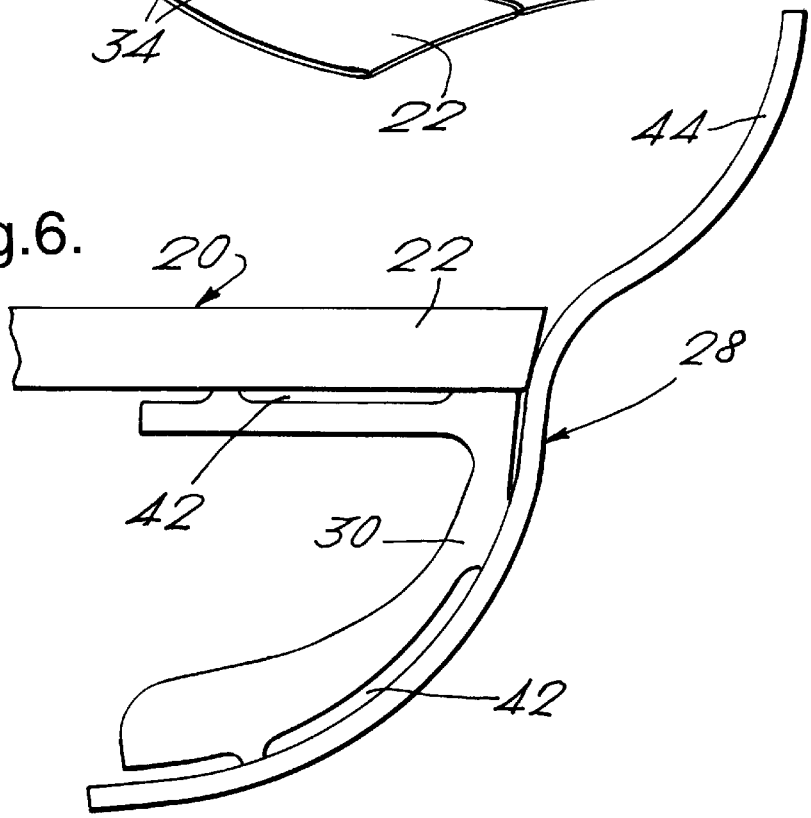
FIG. 6 is another embodiment of the seal and flexible mounting in accordance with the present invention.

In FIG. 6 seal 28 is attached to one portion of the flexible mounting 30 using a bonding material 42 such as a Silcoset™ adhesive. The flexible mounting 30 comprises a flexible material such as silicon rubber. The second portion of the flexible mounting 30 is bonded to the underside of platform 22 again using a suitable bonding material 42 such as Silcoset™. The mounting arrangement is such that, in use, the flexible mounting 30 acts as a hinge between the seal 28 and platform 22. In use the portion of the flexible mounting bonded to the seal 28 moves towards the underside of platform 22 thus acting in a 'see-saw' manner under the centrifugal forces which ensures that end 44 of seal 28 remains in sealing contact with the fan blade during its rotation seal 28 remains in contact with the fan blade. The seal 28 may have an L-shaped cross section.

Figure 7:
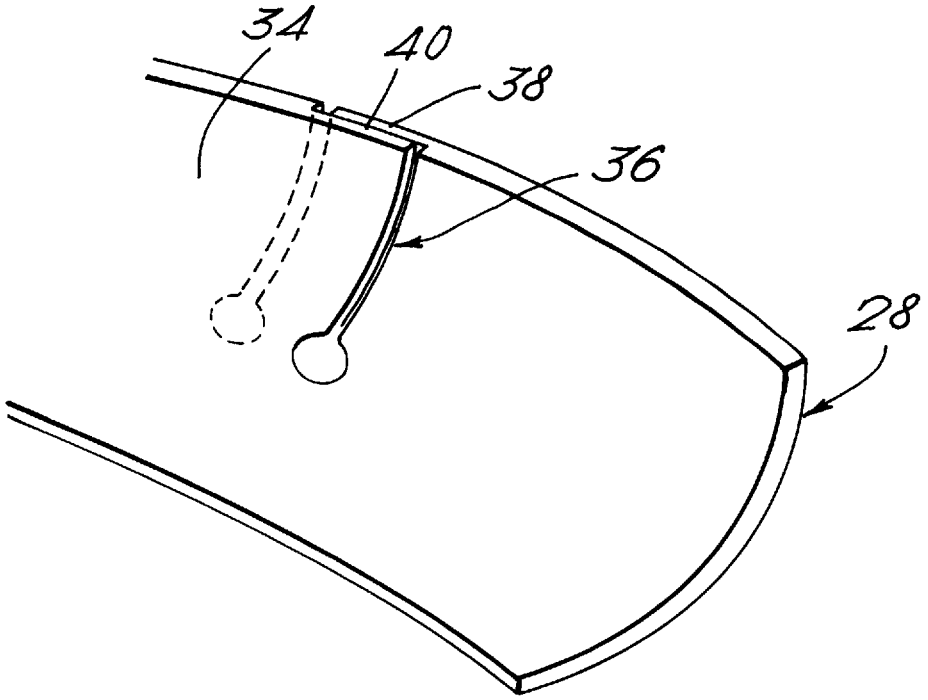
FIG. 7 is a view of a segmented portion of a seal in accordance with the present invention.

In FIG. 7 an enlarged portion of the segmented seal 14 is shown. The slits 39 are cut within the seal to approximately halfway through the radius of the seal and extending approximately halfway through the thickness of the seal from both sides of the seal. The seal is then sliced to provide moveable faces 38,40.

A release film 36 is provided to ensure that faces 38,40 do not stick together during manufacture. The release film 36 is not provided during use of the rotor.

We claim:

1. A rotor for a ducted fan gas turbine engine comprising a rotor disc which has a periphery on which a plurality of circumferentially spaced apart radially extending blades are mounted, discrete wall members being provided to bridge the space between adjacent blades to define an inner wall of a flow annulus through the rotor, each of the wall members being attached to the disc periphery and having opposing side faces which are spaced circumferentially from the adjacent blades and which correspond in profile with blades adjacent thereto, a seal being mounted adjacent at least one opposing side face of the wall members, wherein the seal comprises a stiff material and is bonded to a flexible mounting member, said flexible mounting member being bonded to said wall member face and another portion of said wall member to allow movement of said seal about said wall member while maintaining a seal between said wall member and said adjacent blade, the flexible mounting having elastic properties so as to allow the seal to deflect relative to said wall member under centrifugal loading so as to provide a constant seal with said blade during operation.

2. A rotor as claimed in claim 1 wherein the seal is made from a carbon composite reinforced material.

3. A rotor as claimed in claim 1 wherein the seal comprise at least one segmented portion.

4. A rotor as claimed in claim 1 wherein said segmented portions are of substantially the same identical stiffness.

5. A rotor as claimed in claim 1 wherein the centre of gravity of each of said seals is provided at a position radially inward of its associated platform.

6. A rotor as claimed in claim 4 wherein the free end of said seal extends radially outwards from said wall.

7. A rotor as claimed in claim 1 wherein said seal comprises an L-shaped cross section.

8. A rotor for a ducted fan gas turbine engine comprising a rotor disc which has a periphery on which a plurality of circumferentially spaced apart radially extending blades are mounted, discrete wall members being provided to bridge the space between adjacent blades to define an inner wall of a flow annulus through the rotor, each of the wall members being attached to the disc periphery and having opposing side faces which are spaced circumferentially from the adjacent blades, and which correspond in profile with blades adjacent thereto, a seal being mounted adjacent at least one opposing side face of the wall members, wherein the seal comprises a stiff material and is bonded to a flexible mounting member, said flexible mounting member being bonded to one of said wall member face and said blade, the flexible mounting having elastic properties so as to allow the seal to deflect relative to said wall member under centrifugal loading so as to provide a constant seal with said blade during operation, said data flexible mounting comprising a hinge, said hinge comprising two portions, one portion being bonded to the underneath of the blade and said second portion being bonded to a surface of said seal.

* * * * *